US008201644B2

(12) United States Patent
Hall et al.

(10) Patent No.: US 8,201,644 B2
(45) Date of Patent: Jun. 19, 2012

(54) DUAL PIPE FOR INCREASED FLUID FLOW

(75) Inventors: Adam R. Hall, Perry, OK (US); Richard F. Sharp, Perry, OK (US)

(73) Assignee: The Charles Machines Works, Inc., Perry, OK (US)

( * ) Notice: Subject to any disclaimer, the term of this patent is extended or adjusted under 35 U.S.C. 154(b) by 274 days.

(21) Appl. No.: 12/391,113

(22) Filed: Feb. 23, 2009

(65) Prior Publication Data

US 2009/0211815 A1 Aug. 27, 2009

Related U.S. Application Data

(60) Provisional application No. 61/030,615, filed on Feb. 22, 2008.

(51) Int. Cl.
*E21B 17/00* (2006.01)

(52) U.S. Cl. ..... 175/320; 175/73

(58) Field of Classification Search ..... 175/320, 175/73

See application file for complete search history.

(56) References Cited

U.S. PATENT DOCUMENTS

| | | | | |
|---|---|---|---|---|
| 4,067,596 | A * | 1/1978 | Kellner et al. | 285/123.3 |
| 4,597,454 | A * | 7/1986 | Schoeffler | 175/61 |
| 4,732,223 | A * | 3/1988 | Schoeffler et al. | 175/73 |
| 4,940,098 | A * | 7/1990 | Moss | 175/320 |
| 5,484,029 | A * | 1/1996 | Eddison | 175/73 |
| 7,694,753 | B2 | 4/2010 | Carlson et al. | |

* cited by examiner

*Primary Examiner* — William P Neuder
*Assistant Examiner* — Catherine Loikith
(74) *Attorney, Agent, or Firm* — Tomlinson Rust McKinstry Grable

(57) ABSTRACT

A dual pipe drill string system having increased fluid flow. The dual pipe system comprises a plurality of pipe sections, each pipe section having an inner rod and an outer pipe. The inner rod and the outer pipe of each pipe section may be coupled to the inner rod and outer pipe of an adjacent pipe section. An annulus between the inner rod and the outer pipe defines a fluid flow path through the dual pipe system. The outer pipe defines a shoulder at each end of an individual pipe section. The inner rod defines at least one stop for maintaining the inner rod within the outer pipe. A spacing assembly disposed around the circumference of the inner rod defines paths for fluid flow and maintains a minimum distance between the stop and the shoulder at one end of outer pipe of the pipe section.

19 Claims, 9 Drawing Sheets

DUAL PIPE FOR INCREASED FLUID FLOW

CROSS REFERENCE TO RELATED APPLICATION

This application claims the benefit of provisional patent application Ser. No. 61/030,615 filed on Feb. 22, 2008, the entire contents of which are incorporated herein by reference.

FIELD OF THE INVENTION

The present invention relates to dual-member drill strings and specifically a system for ensuring unobstructed fluid flow through an annulus of a dual member drill string.

SUMMARY OF THE INVENTION

The present invention is directed to a pipe joint for use in drill strings in rotary boring applications. The pipe joint comprises a tubular outer member having a first end and a second end and having an inner surface and an outer surface, an inner member having a first end and a second end, and a spacing assembly having a first end and a second end. The inner surface forms an annular shoulder. The inner member is arranged generally coaxially within the outer member and forms an annular fluid flow path between the inner member and the inner surface of the outer member. The inner member defines a stop sized to restrict axial movement of the inner member in a first direction. The spacing assembly is disposed around a circumference of the inner member, and is positioned between the shoulder of the outer member and the stop of the inner member such that the first end of the spacing assembly is engageable with the shoulder and the second end of the spacing assembly is engageable with the stop. The spacing assembly defines a fluid flow passage in fluid communication with the fluid flow path.

In an alternative embodiment, the present invention is directed to a drill rod assembly, comprising an outer pipe, an inner drill rod, and a means for providing continuous fluid flow. The outer pipe comprises a first inner diameter and a second inner diameter the second inner diameter being greater than the first inner diameter, and a shoulder located at a transition between the first and the second inner diameters. The inner drill rod has a first and second ends. The inner drill rod is positioned within the outer drill rod such that a fluid flow path is defined between the inner and outer drill rods. The inner drill rod includes a knob sized to engage the shoulder of the outer drill rod to limit movement of the inner drill rod relative to the outer drill rod in a longitudinal direction. The means for providing continuous fluid flow is proximate the shoulder and the knob.

DETAILED DESCRIPTION OF THE DRAWINGS

Horizontal boring machines have now almost totally supplanted trenching techniques for laying underground utility lines and other conduits. Various systems are available for directional or steerable drilling. For example, when drilling in soil, a machine with a single drill string with a slant face drill bit is ideal. Drilling of the bore hole occurs while the drill string is rotated. Steering occurs when the slant face bit is advanced without rotating the drill string; the slanted face simply pierces the soil causing the drill bit to be deflected thus altering the angle of the axis of the drill string.

However, this technology is not effective in rocky conditions because the slanted face bit cannot be advanced through rock. Thus, for rock drilling applications, dual-member drill string systems are preferred. Dual-member drill strings are comprised of a plurality of pipe joints, each of which comprises an inner member supported inside an outer pipe or member. The inner member of the drill pipe constantly drives rotation of the boring head and drill bit to excavate the formation, and the outer member of the drill string is selectively rotated to align a steering mechanism to change the direction of the borehole while the rotating bit continues to drill. An exemplary HDD system is disclosed in U.S. Pat. No. 5,682,956, the content of which is incorporated herein in its entirety.

Figure 1A:
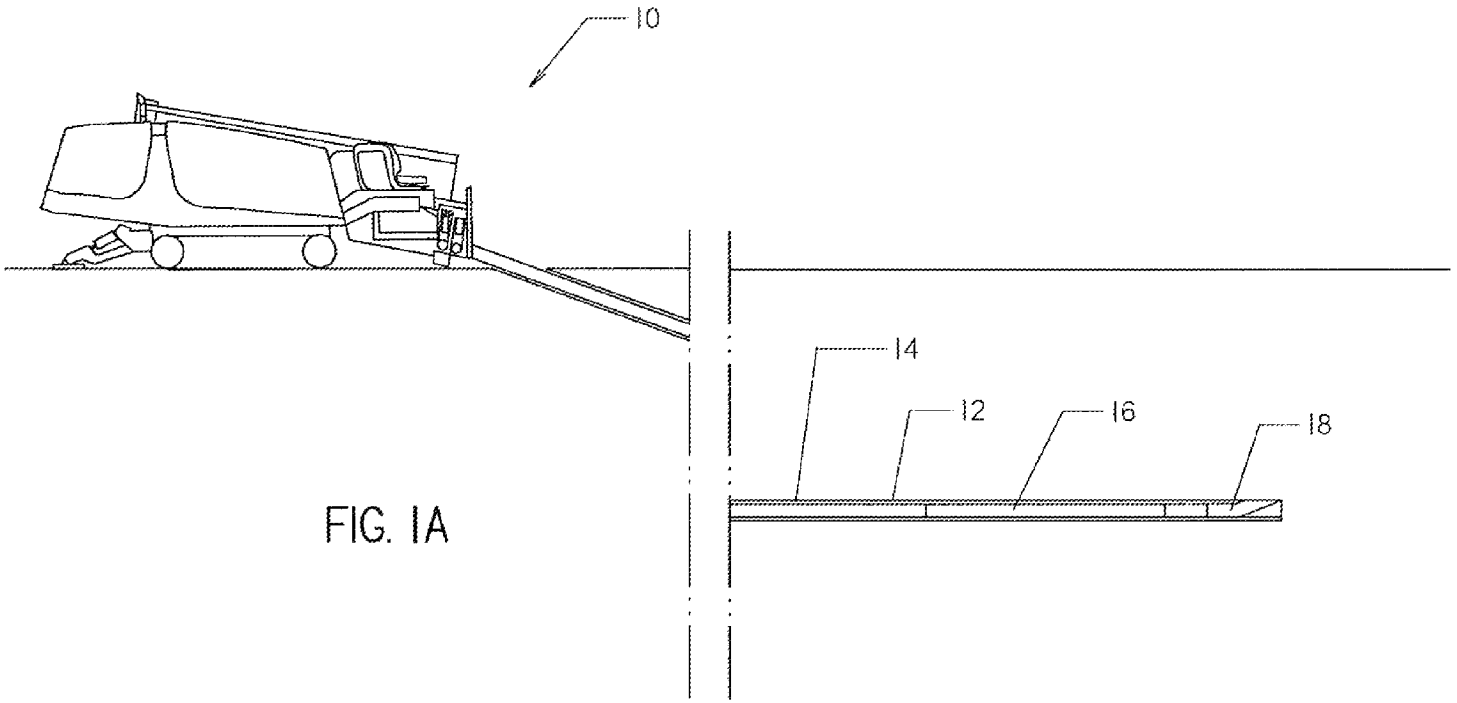
FIG. 1*a* is a partially cross-sectional cut-away side view of a Horizontal Directional Drilling (HDD) system with a dual member drill string built in accordance with the present invention.
Figure 1B:
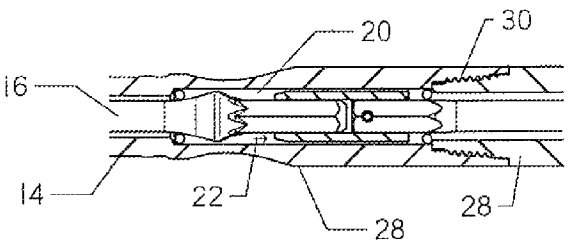
FIG. 1*b* is a side view of the dual member drill string shown in FIG. 1*a*.

Turning now to the figures in general and FIG. 1*a* specifically, a Horizontal Directional Drilling (HDD) system 10 using a dual-member drill string 12 built in accordance with the present invention is shown. The drill string 12 is comprised of a tubular outer member 14, or outer pipe, and an inner member 16, or rod. During the chilling operation, the outer pipe 14 is used for thrust and steering and supply of drilling fluid to a downhole tool 18, whereas the inner rod 16 is used for transmission of power to the downhole tool. The inner rod 16 is arranged generally coaxially within the outer pipe 14. As shown in FIG. 1*b*, this coaxial arrangement forms an annulus 20 between the outer pipe 14 and the inner rod 16. The annulus 20 provides a space for an annular fluid flow path 22 for drilling fluid passing to the downhole tool 18.

Figure 2:
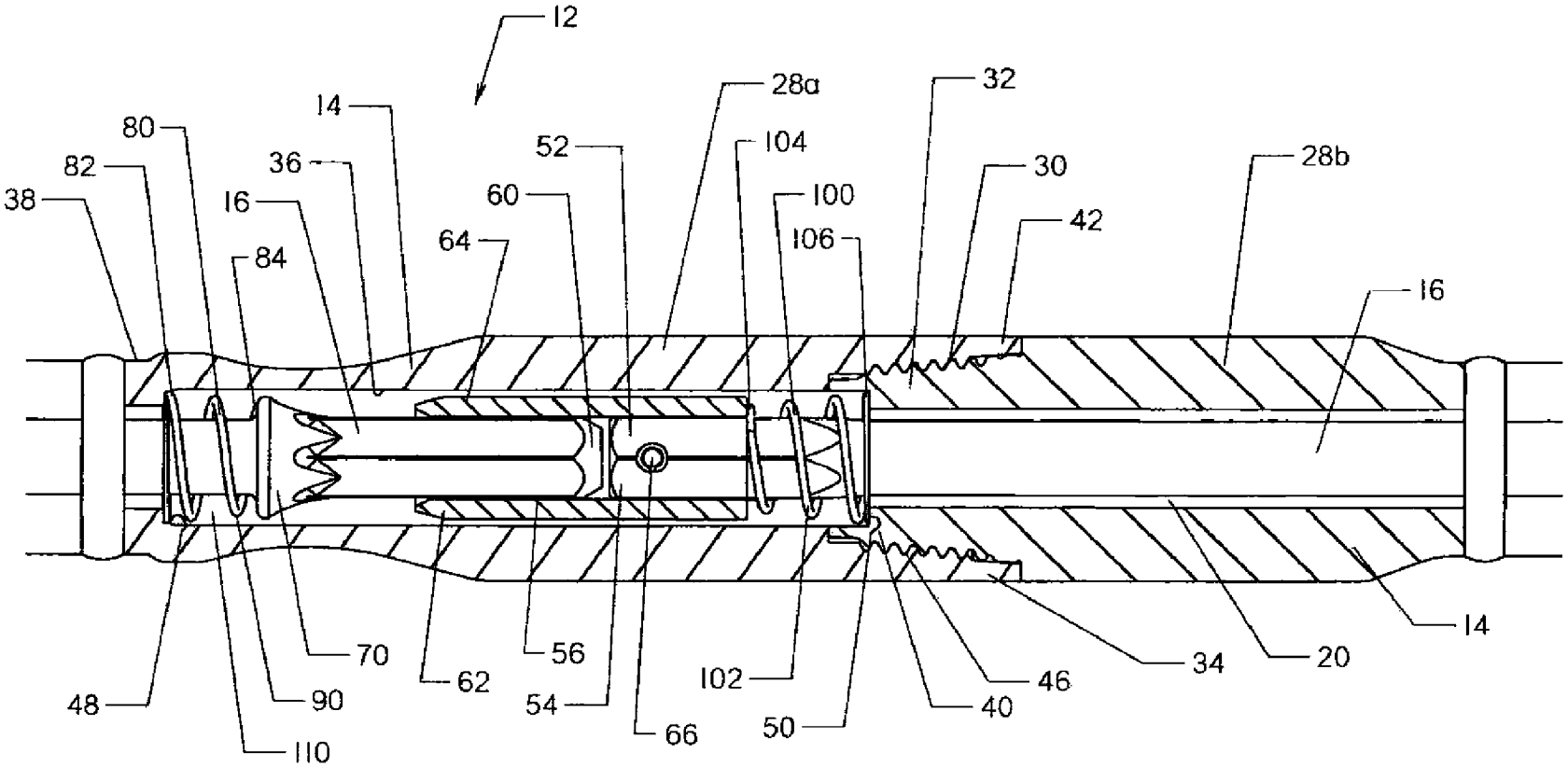
FIG. 2 is a partial cross-sectional side view of the drill string of the present invention having a first spacing assembly comprising a coil spring and a second spacing assembly comprising a coil spring.

The drill string 12 is comprised of a plurality of pipe segments 28 which are adapted to couple at pipe joint connections 30. Referring now to FIG. 2, there is shown therein a pipe joint connection 30 connecting the pipe sections 28*a* and 28*b*. Each pipe segment 28 is comprised of the tubular outer member 14 and the inner member 16. The tubular outer member 14 has a first end 32 and a second end 34 and an inner surface 36 and an outer surface 38. For illustration purposes and as shown in FIG. 2, the first end 32 (uphole end) is shown as part of the pipe segment 28*b* and the second end 34 (downhole end) is shown as part of the pipe segment 28*a*. One skilled in the art will appreciate that each pipe segment 28 of the drill string 12 has ends of the features described herein.

Preferably, the first end 32 comprises a pin end 40 and the second end 34 comprises a box end 42, wherein the box end of the outer pipe 14 of the segment 28*a* is adapted to couple with the pin end of the outer pipe of the second pipe segment 28*b*. More preferably, the pin end 40 will couple to the box end 42 in a threaded connection 46. The inner surface 36 of the outer member 14 defines a first shoulder 48 at the second end 34 of the outer member. The inner surface 36 defines a second shoulder 50 proximate the first end of the outer pipe 14.

A first end 52 of the inner member 16 comprises a box end 54 forming a geometrically shaped recess 56 and a second end 58 of the inner member comprises a geometrically-shaped pin end 60. The recess 56 in the box end 54 of the inner member 16 is designed to correspond to the shape of the pin end 60 of the inner member such that the pin end of the inner member of the first segment 28*a* is slideably receivable within the recess of the box end of the inner member of the second pipe joint segment 28*b*. In the preferred embodiment, the second end 58 of the inner member 16 is disposed within the second end of the outer member 14. The first end 54 of the inner member 16 preferably extends beyond the first end 34 of the outer member 14. More preferably, the first end 54 of the inner member comprises a radially projecting annular stop member 62. Most preferably, the annular stop member 62 comprises a collar 64 secured to the inner member 16 with a set screw 66 or other retention apparatus.

The inner rod 16 is further contained by a protruding knob or stop 70 proximate the second end 58 of the inner member and sized such that it cannot pass through the first shoulder 48 of the outer member 14. At the first shoulder 48 a first inner diameter of the outer pipe 14 is smaller than an outer diameter of the knob 70, restricting axial movement of the inner rod 16 in a first direction. Preferably, the first direction is uphole relative to the outer member 16. At the second shoulder 50 the inner diameter of the outer pipe 14 is smaller than an outer diameter of the collar 64 restricting axial movement of the inner rod 16 in a direction substantially opposite the first direction. In this arrangement, the inner pipe 16 and the outer pipe 14 must remain within a set of tolerances such that the plurality of collars 64 along a string of the dual-member drill string 12 always have enough engagement to transfer torque to the inner rod 16 of the next segment 28*b* without premature wear or breakage. Tolerances must also allow for elongation of the outer pipe 14 due to pulling the product drill string 12 during a backream operation and shrinkage of the outer pipe during drilling. These occurrences may obstruct the fluid flow path 22 across one or more pipe joints 30 along the drill string 12 due to the flow being restricted either around the collar 64 or at the knob 70. If the knob 70 comes in contact with the first shoulder 48 or if the collar 64 comes in contact with the second shoulder 50, fluid flow 22 may be restricted and flow through the pipe joint 30 to the downhole tool 18 may not be sufficient. The present invention is advantageous because it provides for the segment 28, which both secures the inner rod 16 within the outer pipe 14 and allows for sufficient fluid flow 22 through the pipe joint 30 at both the first shoulder 48 and the second shoulder 50 during all aspects of drilling and backreaming operations.

With continued reference to FIG. 2, the drill string 12 pipe section 28 comprises a spacing assembly 80. The spacing assembly 80 has a first end 82 and a second end 84. The spacing assembly 80 is disposed around a circumference of the inner rod 16 and is positioned between the first shoulder 48 and the knob 70 such that the first end 82 of the spacing assembly is engageable with the first shoulder and the second end 84 of the spacing assembly is engageable with the knob. In the embodiment of the spacing assembly 80 shown in FIG. 2, the spacing assembly comprises at least a first coil compression spring 90. As shown, the first compression spring 90 extends from the first end 82 at the first shoulder 48 to the second end 84 proximate the knob 70.

Each pipe section 28 further comprises a second spacing assembly 100 comprising a second compression spring 102 which extends from a first end 104 proximate the collar 64 to a second end 106 proximate the second shoulder 50. Preferably, spring force counteracts axial forces on the inner rod 16, such as fluid drag, to hold the inner rod in the proper position. Spring 90, 102 centering prevents the knob 70 and collar 64 from contacting the shoulders 48, 50 when the outer pipe 14 stretches or compresses under high force. Preferably, the springs 90, 102 are arranged such that at least one gap 110 remains between the coils even when compressed. Thus, the fluid flow path 22 through the annulus 20 and pipe joint 30 is unrestricted. More preferably, the one spring 90, 102 is a right-handed spring and the other spring is a left-handed spring. The springs are positioned such that rotation of the inner pipe 16 does not cause the unwinding of either spring 90, 102. Hardened washers (not shown), properly sized to not inhibit the fluid flow path 22 may be placed at one or both ends of the springs 90, 102 to improve wear life.

Figure 3:
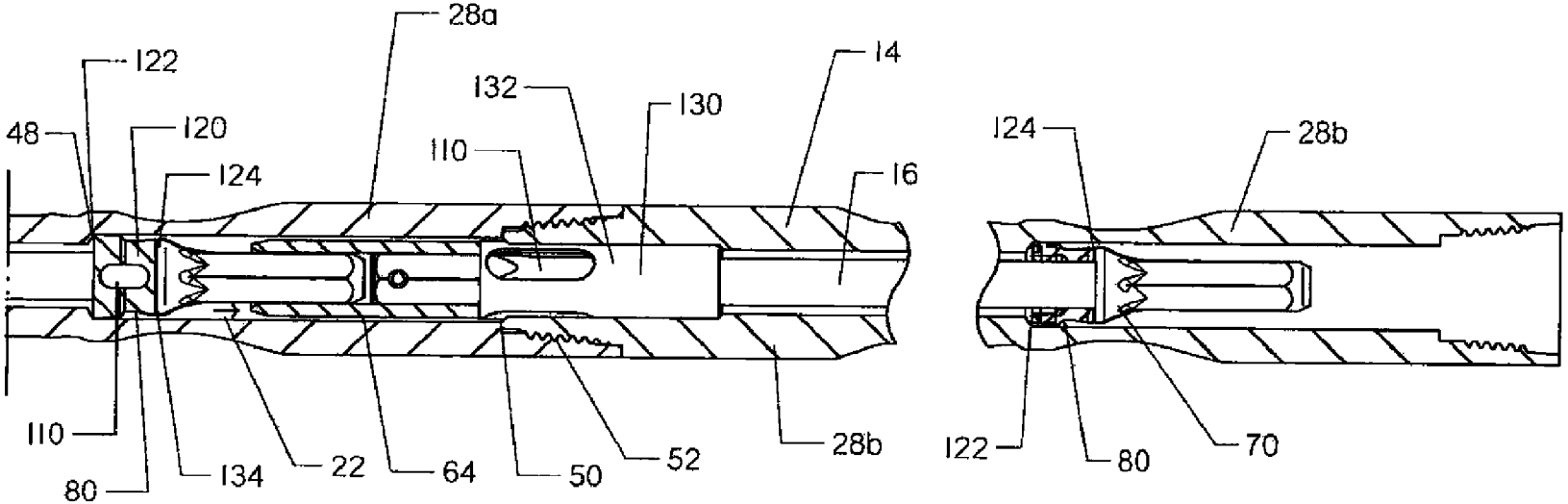
FIG. 3 is a partial cross-sectional side view of an alternative embodiment of the drill string having a first spacing assembly comprising a flow spacer and a second spacing assembly comprising a sleeve.

Turning now to FIG. 3, an alternative embodiment of the pipe segment 28 is shown. In FIG. 3, the spacing assembly 80 comprises a flow spacer ring 120. The flow spacer ring 120 comprises a first end 122 and a second end 124. As shown, the flow spacer ring 120 extends from the first shoulder 48 at the first end 122 to the knob 70 at the second end 124. Preferably, the flow spacer ring 120 is wider at the first end 122 than at the second end 124, and defines a gap 110 or slot between the first end and the second end such that the fluid flow path 22 can pass through the flow spacer ring. Alternatively, the flow spacer ring 120 may comprise a plurality of gaps or slots 110.

With continued reference to FIG. 3, a second flow spacer 130 is disposed around the first end 52 of the second segment 28*b* of the inner member 16. The second flow spacer 130 preferably comprises a sleeve 132. The sleeve 132, disposed around the circumference of the inner member 16, extends between the collar 64 to or through the second shoulder 50. The sleeve 132 comprises a gap 110 or flow slot which maintains an unrestricted fluid flow path 22 along a length of the inner rod 16.

With reference again to FIG. 3, the knob 70 is shown having a flat abutment surface 134 which contacts the second end 124 of the flow spacer ring 120. This allows a greater area of contact between the second end 124 of the flow spacer ring 120 and the knob 70 when the fluid spacer ring and the knob are in contact.

One skilled in the art will appreciate that such contact is not necessarily continuous. In a preferred embodiment, the fluid spacer ring 120 is not permanently engaged at either the first shoulder 48 or the knob 70, but only engages the first shoulder and the knob when the position of the inner rod 16 and outer pipe 14 are subject to operational stresses. Likewise the sleeve 132 is not permanently engaged at the collar 64 or the second shoulder 50. One skilled in the art can calculate how much the outer pipe 14 will compress or stretch under maximum forces. Therefore, the proper length of the particular fluid flow spacer 120 or sleeve 132 may be determined such that transfer of tension to the inner rod 16 may be avoided.

The embodiment of FIG. 3 may also be utilized without a knob 70 comprising a flat surface. Alternatively, the spacing assembly 80 may comprise two fluid flow spacers 120 or two sleeves 132. In another alternative, the spacing assembly 80 may comprise only one flow spacer ring 120. The flow spacing assembly 80 may also be shaped to allow increased contact with a standard knob 70 without an abutment surface 134. This is advantageous as it allows the inner rod to be manufactured with little or no modification to existing tooling.

Figure 4:
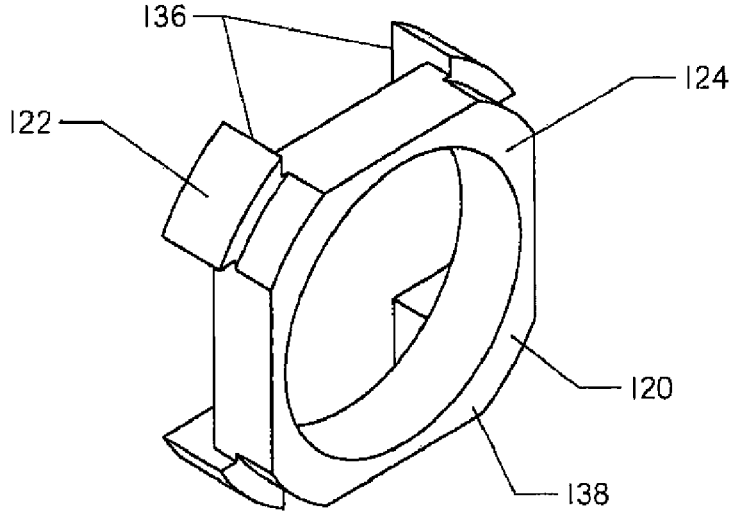
FIG. 4 is a partial cross-sectional side view of an alternative embodiment of the flow spacer of FIG. 3.

Turning now to FIG. 4, an alternate embodiment of the flow spacer ring 120 is shown in detail. The first end 122 comprises a plurality of feet 136 adapted to engage the first shoulder 48. The second end 124 comprises a ring surface 138 adapted to engage the knob 70. The feet 136 are set wider than the ring surface 138 such that gaps 110 allow continuous fluid flow 22.

With reference again to FIG. 3, the fluid flow spacer 120 or sleeve 132 which is most "upstream" relative to a direction of the fluid flow path 22 may not be necessary if the proper distance between the collar 64 and the second shoulder 50 is provided in the drill string 12. If properly measured, drag forces against the knob 70 will hold the fluid flow path 22 around the knob open provided tolerances and impedances to flow are accounted for.

Figure 5:
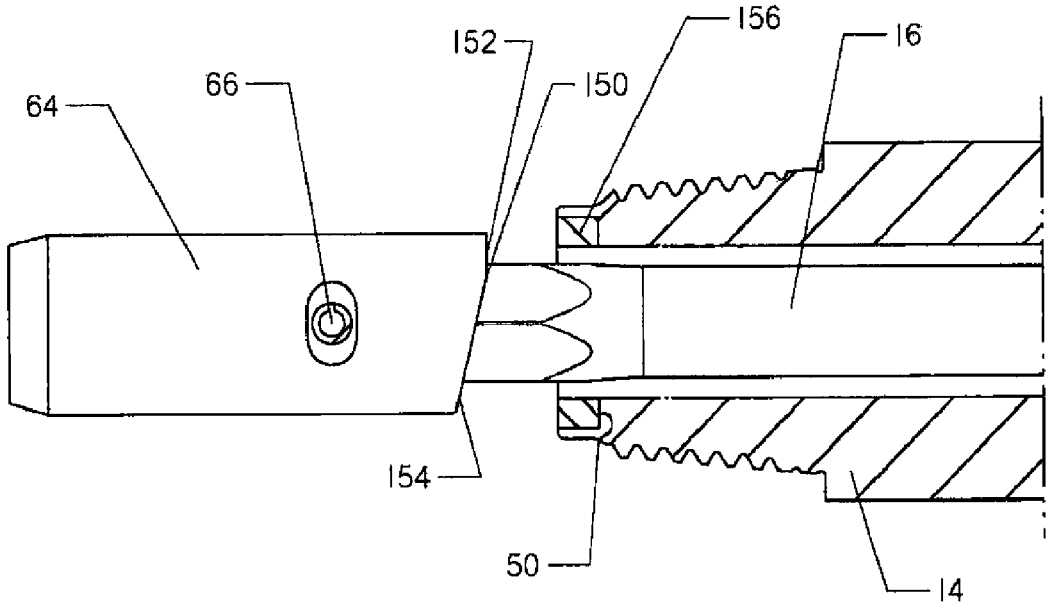
FIG. 5 is a partial cross-sectional side view of a collar having a partially-slanted abutment surface.

Referring now to FIG. 5, an embodiment which may be used in combination with one or more of the previous embodiments is shown. The collar 64 surrounding the inner rod 16 comprises a partially slanted abutment surface 150. The abutment surface comprises an engagement surface 152 and a slanted surface 154. The engagement surface 152 is engageable either at the second shoulder 50 or the spacing assembly 80 proximate the second shoulder. Alternatively, a partially slanted abutment surface 150 may be utilized with the knob 70 and the first shoulder 48. The slanted surface 154 ensures that a portion of the collar maintains clearance between the stop member 70, 64 and the shoulder 48, 50, defining the gap 110 for the fluid flow path 22.

One skilled in the art will appreciate that the embodiment of FIG. 5 may result in uneven wear of the stop 64 and the shoulder 50. As shown in FIG. 5, a replaceable hardened ring 156 may be utilized at the shoulder 50. Further, the collar 64 may be replaced when the engageable surface 152 wears down and the slanted surface 154 is lost or compromised.

Figure 6:
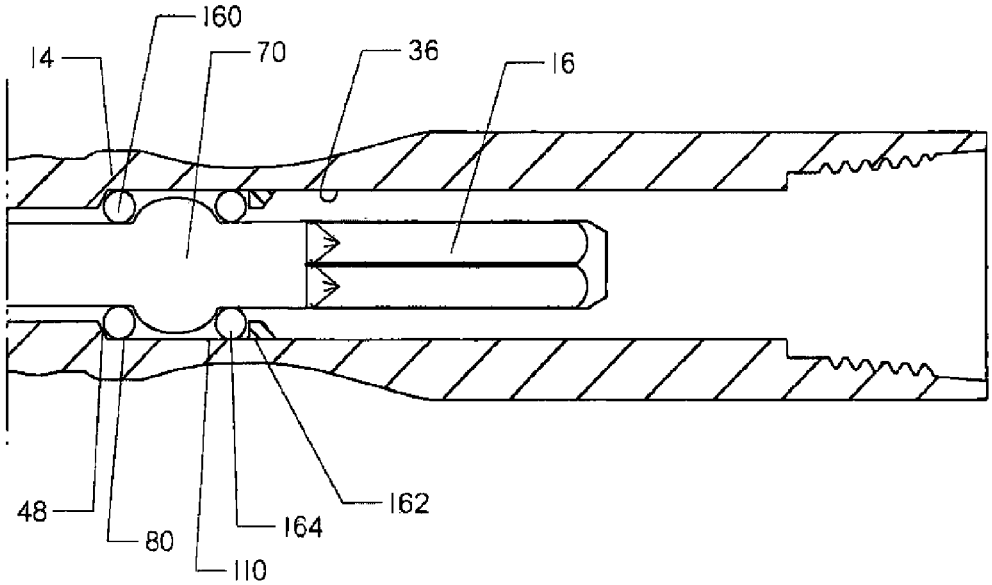
FIG. 6 is a partially cross-sectional side view of an alternative embodiment of the pipe joint having a spacing assembly comprising a plurality of rolling elements.
Figure 7:
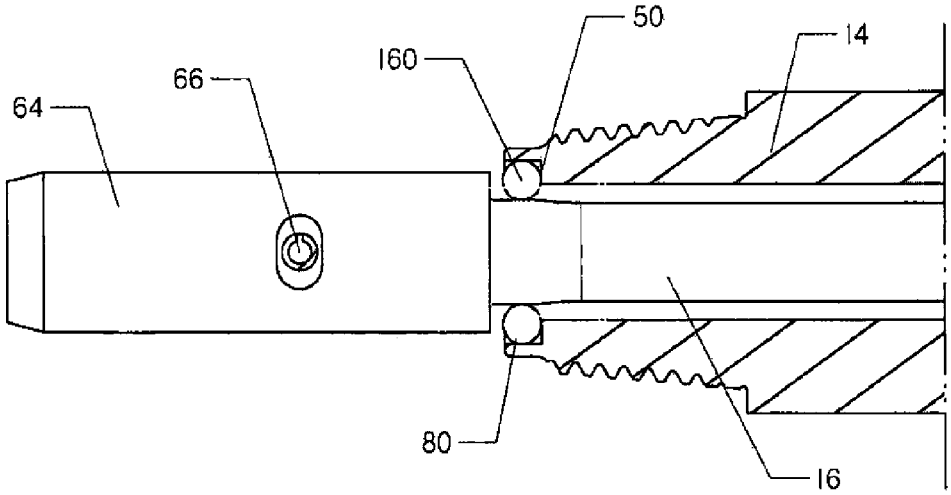
FIG. 7 is a partially cross-sectional side view of another embodiment of the pipe joint having a spacing assembly comprising a plurality of rolling elements.

With reference now to FIG. 6, an alternative spacing assembly 80 for the modified pipe segment 28 is shown. As shown therein, the spacing assembly comprises a plurality of rolling elements 160 located between the first shoulder 48 and the knob 70. The rolling elements 160 are adapted to freely engage the first shoulder 48 and the knob 70 while defining a minimum distance between the shoulder and the knob. The inner surface 36 of the outer pipe 14 comprises a retaining element 162 located such that the knob 70 is between the first shoulder 48 and the retaining element. As shown, the spacing assembly 80 comprises a second plurality 164 of rolling elements 160 located between the retaining element 162 and the knob 70, each of the plurality defining a minimum distance between the retaining element and the knob. The rolling elements 160 are disposed about the circumference of the inner rod 16 such that gaps 110 between the plurality of rolling elements provide for an unobstructed fluid flow path 22. As shown in FIG. 7, the plurality of rolling elements 160 may likewise be placed between the collar 64 and the second shoulder 50. Further, the spacing assemblies 80 of FIGS. 6 and 7 may be utilized together, individually, or in combination with one or more of the other spacing assemblies discussed herein. Preferably, each of the plurality of rolling elements 160 comprises a hardened sphere, such as a bearing ball.

Figure 8:
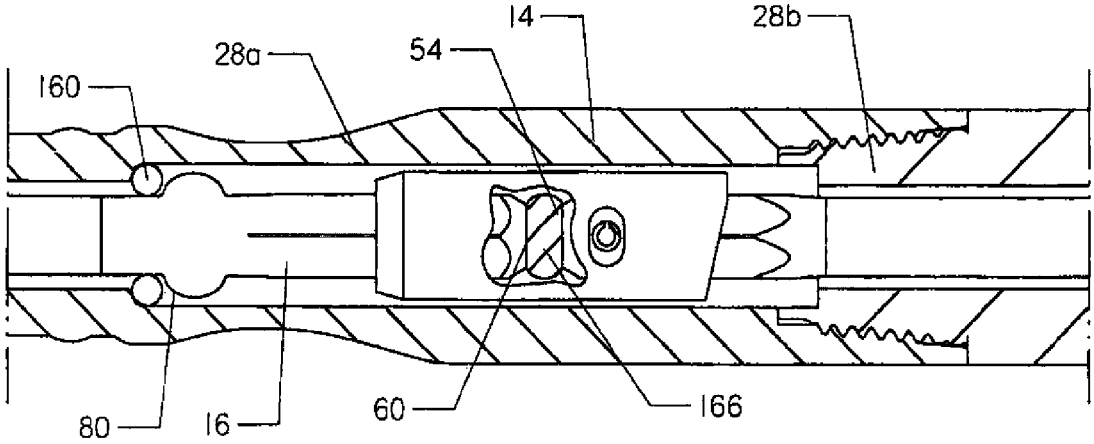
FIG. 8 is a partially cross-sectional side view of the drill string of FIG. 1 having a spacing assembly comprising a plurality of rolling elements, a resilient element, and a collar having a partially-slanted abutment surface.

With reference now to FIG. 8, the spacing assembly 80 of FIGS. 6 and 7 further comprises a resilient element 166. The resilient element 166 is held within the collar 64 such that it is held between the pin end 60 of the inner rod 16 and the box end 54 of the inner rod of the second segment 28*b*. When the adjacent inner rods 16 are connected, the plurality of rolling elements 160 of FIG. 6 is held in place by the resilient element 166. The resilient element 166 may comprise a compressible elastomeric material, a compression spring, or other similar element.

Figure 9A:
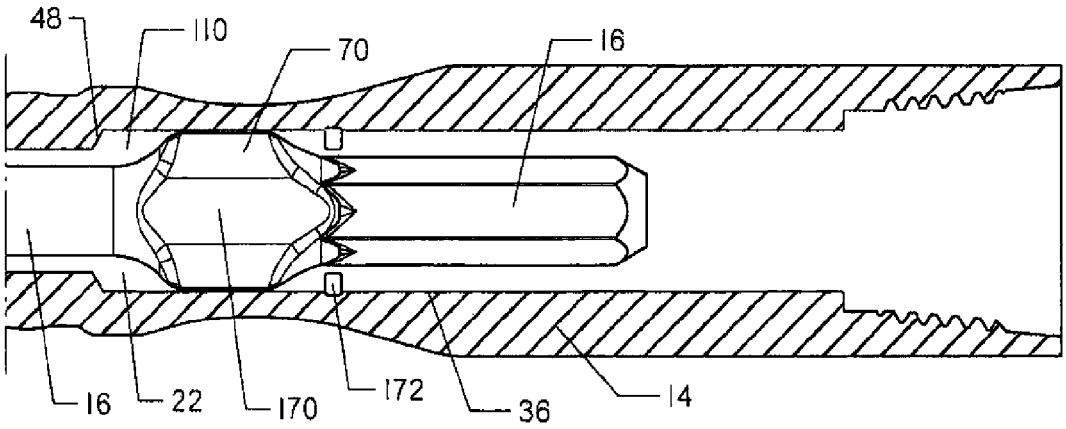
FIG. 9A is a partially cross-sectional perspective view of an alternative drill string having a non-symmetrical knob.
Figure 9B:
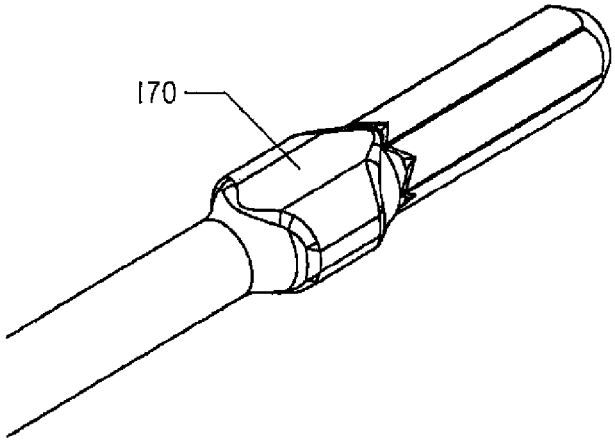
FIG. 9B is a perspective view of the knob of FIG. 9A.

With reference now to FIGS. 9A and 9B, an alternative embodiment of the pipe segment 28 is disclosed which allows an unobstructed fluid flow path 22 without the use of the spacing assembly. In this embodiment, the knob 70 comprises an additional knob feature that causes the knob to only partially engage the first shoulder 48. As shown therein the knob 70 feature comprises a flat surface 170, such that when the knob contacts the first shoulder 48, the fluid flow path 22 is unobstructed due to a gap 110 created by the flat surface. A rod retainer 172 is provided on the inner surface 36 of the outer pipe 14 such that the knob 70 is kept in proximity of the first shoulder 48. Alternatively, the retainer 172 may be placed on the inner rod 16.

Figure 10:
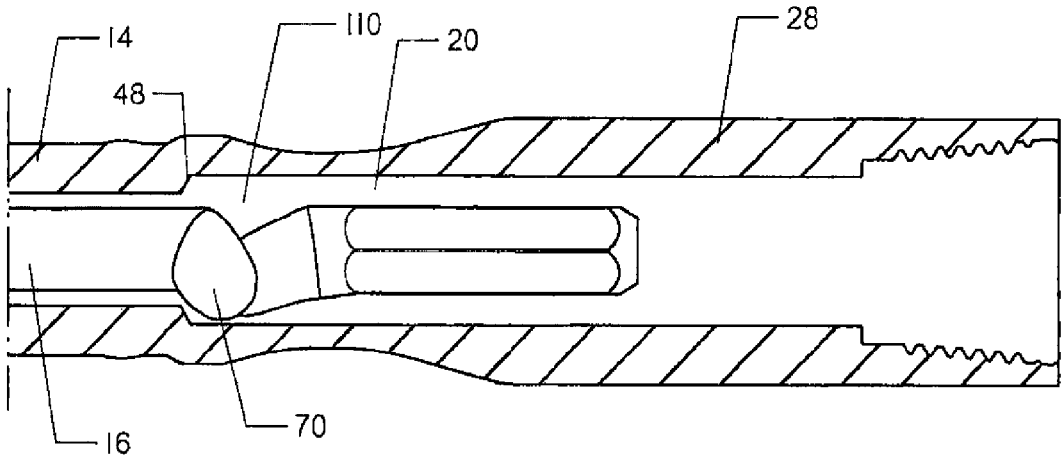
FIG. 10 is a partially cross-sectional side view of an alternative drill string having an offset knob.

Referring now to FIG. 10, shown therein is the knob 70 on the inner member 16 having an alternative feature to that shown in FIG. 9. In the alternative embodiment, the knob 70 is not coaxial with an axis or centerline of the inner rod 16 and the outer pipe 14, such that a gap 110 is created when the knob 70 contacts the first shoulder 48. In this embodiment, the annulus 20 of the pipe section 28 must be sized such that 360° of rotational clearance is given for the knob 70 to prevent wear during rotation of the inner rod 16.

Figure 11:
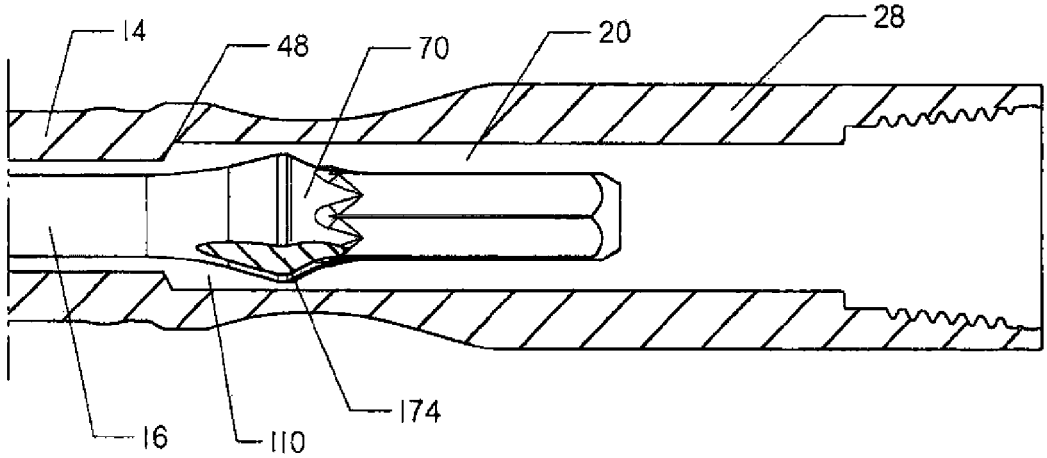
FIG. 11 is a partially cross-sectional side view of an alternative drill string having a grooved knob.

FIG. 11 shows yet another alternative for the knob 70, in which the knob feature comprises grooves 174 in the surface of the knob. The grooves 174 are preferably sized such that one or more gaps 110 are created when the knob contacts the first shoulder 48. Preferably, there are not more than six such grooves 174 in the surface of the knob 70.

Figure 12A:
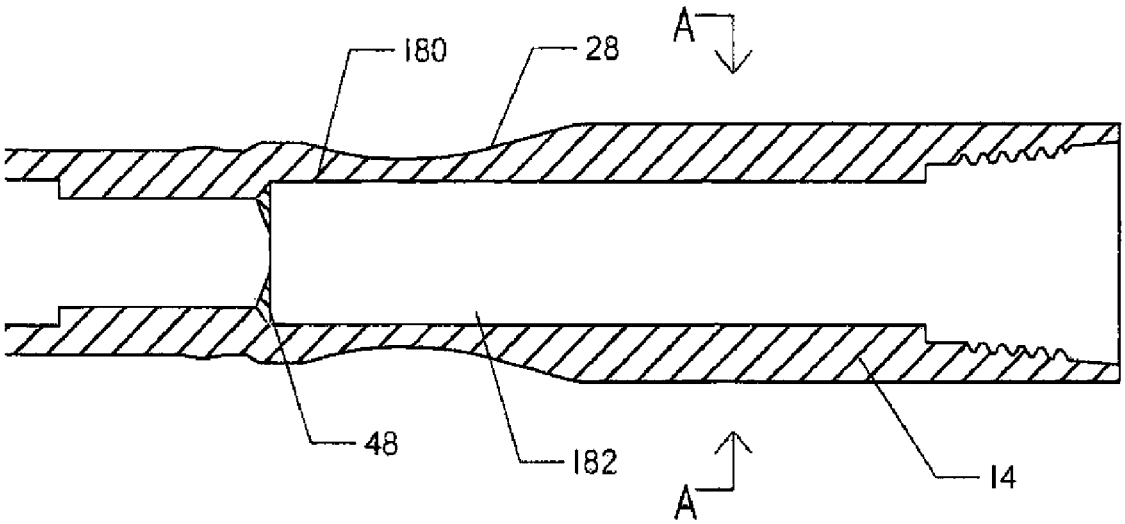
FIG. 12A is a cross-sectional side view of an outer member of a drill string having a modified bore.
Figure 12B:
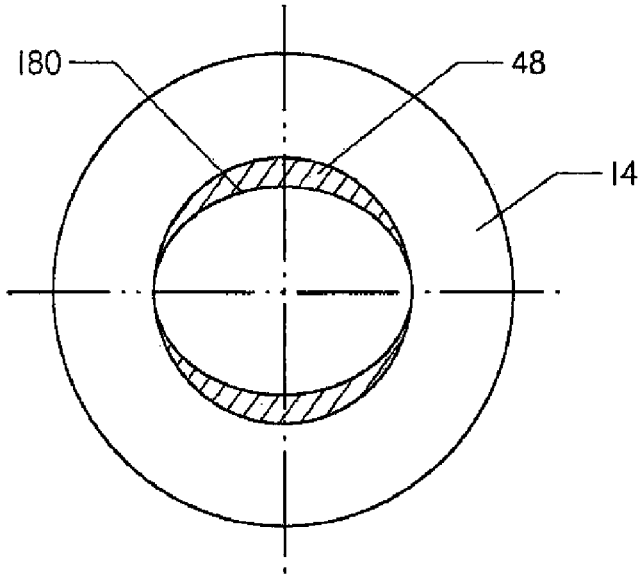
FIG. 12B is a sectional view of the member of FIG. 12A at reference line A.

Referring now to FIGS. 12A and 12B, an alternative design for the outer pipe 14 of a pipe section 28 is described. As shown therein, a modified bore 180 of the inner surface 36 of the outer pipe 14 is proposed. Preferably, the modified bore 180 will comprise an elliptical cross-section, as shown in FIG. 12B. When utilized with the knob 70 configurations previously discussed, the modified bore 180 ensures that only a portion of the knob abuts the elliptical cross-section of the first shoulder 48 so that the fluid flow path can never become restricted. The modified bore 180 may be tapered and need not extend a full length 182 of the interior of the pipe section 28, provided it intersects the first shoulder 48. Alternatively, the bore 180 may be machined to form shoulder at a right angle to the inner surface 36 of the pipe 14.

Flow restriction problems may also be overcome for dual member drill strings 12 without significant modification by periodic insertion of a modified segment 28. The modified segments 28 may be used at intervals appropriate to the forces placed on the drill string 12 due to thrust and pullback forces. One skilled in the art can envision other potential combinations of the principles disclosed in the above embodiments to create a dual-member drill string 12 composed of connected segments 18 that meet the previously stated objectives of containment of the inner rod 16 within and aligned with the outer pipe 14 longitudinally as well as concentrically, joining of dual-member drill string segments 29 together in a manner that assures an adequate fluid flow path 22 to downhole tools 18 across the broad expected range of drilling operations, and ease of manufacture and assembly. The inner rods 16 may be shortened to prevent their end-to-end stack up in long drill strings 12, the amount of shortening being primarily determined by stack up of pertinent manufacturing tolerances and outer pipe length shrinkage under full thrust force.

What is claimed is:

1. A pipe joint for use in drill strings in rotary boring applications, the pipe joint comprising:

a tubular-outer member having a first end and a second end and having an inner surface and an outer surface, the inner surface forming an annular shoulder;

an inner member having a first end and a second end, the inner member being arranged generally coaxially within the outer member and forming an annular fluid flow path between the inner member and the inner surface of the outer member; and a spacing assembly having a first end and a second end;

wherein the spacing assembly is unattached to both the inner member and the outer member;

wherein the inner member defines a stop sized to restrict axial movement of the inner member in a first direction; and wherein the spacing assembly is disposed around a circumference of the inner member, and is positioned between the shoulder of the outer member and the stop of the inner member such that the first end of the spacing assembly is engageable with the shoulder and the second end of the spacing assembly is engageable with the stop; and wherein the spacing assembly defines a fluid flow passage in fluid communication with the fluid flow path.

2. The pipe of claim 1 wherein the second end of the inner member comprises a geometrically-shaped pin end and the first end of the inner member comprises a box end forming a geometrically-shaped recess corresponding to the shape of the pin end of the inner member, the pin end being slideably receivable within the box end of a similarly formed inner member.

3. The pipe of claim 1 further comprising a second spacing assembly having a first end and a second end;

wherein the first end of the inner member extends a distance beyond the first end of the outer member and a second stop disposed at the first end of the inner member beyond the first end of the outer member; and wherein the second spacing assembly is disposed around a circumference of the inner member, and is positioned between the first end of the outer member and the stop member of the inner member such that the first end of the spacing assembly is engageable with second stop member and the second end of the spacing assembly is engageable with the second end of the outer member; and wherein the second spacing assembly defines a second fluid flow passage in fluid communication with the fluid flow path.

4. The pipe of claim 3 wherein the stop sized to restrict axial movement of the inner member in the first direction comprises a collar and a retaining apparatus.

5. The pipe of claim 4 wherein the retaining apparatus comprises a set screw.

6. The pipe of claim 3 wherein the spacing assembly comprises a coil spring and the second spacing assembly comprises a coil spring.

7. The pipe of claim 3 wherein the spacing assembly comprises a coil spring.

8. The pipe of claim 3 wherein the spacing assembly comprises an annular ring.

9. The pipe of claim 8 wherein the annular ring comprises at least one fluid-flow enabling gap.

10. The pipe joint of claim 8 wherein the annular ring comprises a fluid flow enabling longitudinal slot.

11. The pipe of claim 3 wherein the spacing assembly comprises at least one rolling element.

12. The pipe of claim 1 further comprising a second spacing assembly having a first end and a second end;

wherein the second end of the inner member is contained within a box joint of the second end of the outer member proximate a second shoulder and a second stop is disposed at the second end of the inner member within the second end of the outer member; and wherein the second spacing assembly is disposed around a circumference of the inner member, and is positioned between the second shoulder of the outer member and the second stop member of the inner member such that the first end of the spacing assembly is engageable with second stop member and the second end of the spacing assembly is engageable with the second shoulder; and wherein the second spacing assembly defines a second fluid flow passage in fluid communication with the fluid flow path.

13. The pipe of claim 1 further comprising a second spacing assembly having a first end and a second end;

wherein the inner member defines a second stop sized to restrict axial movement of the inner member in a second direction wherein the second direction is opposite the first direction; and wherein the second spacing assembly is disposed around a circumference of the inner member, and is positioned between the shoulder of the outer member and the second stop of the inner member such that the first end of the second spacing assembly is engageable with the shoulder and the second end of the second spacing assembly is engageable with, the second stop; and wherein the second spacing assembly defines a fluid flow passage in fluid communication with the fluid flow path.

14. A drill rod assembly, comprising:

an outer pipe comprising a first inner diameter and a second inner diameter, the second inner diameter being greater than the first inner diameter; and a shoulder located at a transition between the first and the second inner diameters;

an inner drill rod having a first and second ends, the inner drill rod being positioned within the outer pipe such that a fluid flow path is defined between the inner drill rod and outer pipe, the inner drill rod including a knob sized to engage the shoulder of the outer pipe to limit movement of the inner drill rod relative to the outer pipe in a longitudinal direction; and a means for providing continuous fluid flow proximate the shoulder and the knob, wherein the means for providing continuous flow is unattached to both the inner drill rod and outer pipe.

15. The drill rod assembly of claim 14 wherein, the means for providing continuous fluid flow comprises a knob feature, wherein the knob feature does not fully engage the shoulder of the outer drill rod while allowing the knob to partially engage the shoulder of the outer drill rod to limit movement of the inner drill rod relative to the outer drill rod in a longitudinal direction without obstructing the fluid flow path.

16. The assembly of claim 15 wherein the knob feature comprises a flat surface.

17. The assembly of claim 15 wherein the knob feature comprises a grooved surface.

18. The assembly of claim 15 wherein:

the inner drill rod defines a centerline; and the knob is offset from the centerline.

19. A drill rod assembly, comprising:

an outer pipe comprising a first inner diameter and a second inner diameter, the second inner diameter being greater than the first inner diameter; and a shoulder located at a transition between the first and the second inner diameters;

an inner drill rod having a first and second ends, the inner drill rod being positioned within the outer pipe such that a fluid flow path is defined between the inner drill rod and outer pipe, the inner drill rod including a knob sized to engage the shoulder of the outer pipe to limit movement of the inner drill rod relative to the outer pipe in a longitudinal direction; and a means for providing continuous fluid flow proximate the shoulder and the knob;

wherein the means for providing continuous fluid flow comprises a spacing assembly between the inner drill rod and the outer pipe defining fluid flow passages in fluid communication with the fluid flow path, the spacing assembly comprising a first end and a second end, wherein the first end is engageable with the shoulder and the second end is engageable with the knob such that a minimum distance is maintained between the knob and the shoulder of the outer pipe.

* * * * *